United States Patent [19]

Corsten et al.

[11] Patent Number: 4,841,875

[45] Date of Patent: Jun. 27, 1989

[54] SUSPENSION ARRANGEMENT FOR RAIL VEHICLES

[75] Inventors: Leonhard Corsten, Herzogenrath, Fed. Rep. of Germany; Franz-Joseph Collienne, Eupen, Belgium; Johannes Nicolin, Aachen, Fed. Rep. of Germany

[73] Assignee: Waggonfabrik Talbot, Aachen, Fed. Rep. of Germany

[21] Appl. No.: 18,612

[22] Filed: Feb. 25, 1987

[30] Foreign Application Priority Data

Feb. 27, 1986 [DE] Fed. Rep. of Germany ..... 3606325

[51] Int. Cl.[4] ..... B61F 5/30

[52] U.S. Cl. ..... 105/224.05; 105/224.1; 267/3

[58] Field of Search ..... 105/218.1, 220, 221.1, 105/223, 224.05, 224.06, 224.1, 198.7, 225; 267/3, 4; 280/716

[56] References Cited

U.S. PATENT DOCUMENTS

| | | | |
|---|---|---|---|
| 1,834,450 | 12/1931 | Flintermann | 267/141.7 |
| 2,136,733 | 11/1938 | Dean | 105/225 |
| 2,782,026 | 2/1957 | Hirst | 267/3 |
| 3,030,099 | 4/1962 | Piatscheck | 267/3 |
| 3,882,794 | 5/1975 | Stieler et al. | 105/223 X |
| 4,166,611 | 9/1979 | Geers et al. | 105/224.1 X |
| 4,433,629 | 2/1984 | Roush, Jr. | 105/224.05 X |

FOREIGN PATENT DOCUMENTS

| | | | |
|---|---|---|---|
| 847385 | 8/1952 | Fed. Rep. of Germany . | |
| 1047540 | 12/1958 | Fed. Rep. of Germany . | |
| 1142895 | 1/1963 | Fed. Rep. of Germany | 105/224.1 |
| 1230834 | 12/1966 | Fed. Rep. of Germany . | |
| 2157585 | 6/1973 | Fed. Rep. of Germany . | |
| 2404768 | 8/1975 | Fed. Rep. of Germany . | |
| 2525450 | 12/1976 | Fed. Rep. of Germany . | |
| 2306375 | 10/1976 | France | 280/716 |

OTHER PUBLICATIONS 60-62 607, vol. 10 No. 88 (M-467) (2145) Apr. 5, 1986 Rubber Spring for Railway Vehicle, Hideo Takai.

*Primary Examiner*—Robert B. Reeves
*Assistant Examiner*—Frank H. Williams, Jr.
*Attorney, Agent, or Firm*—Becker & Becker, Inc.

[57] ABSTRACT

A suspension arrangement for rail vehicles, including at least one pair of superimposed elastomeric shock absorbers, including a first shock absorber disposed between a first mandrel and a first bell-shaped member, and a second shock absorber disposed between a second mandrel and a second bell-shaped member. The first bell-shaped member and the second mandrel are disposed between the two shock absorbers and are interconnected in such a way that they can carry out not only a movement in the main direction of shock absorption, but also a pendulum movement about any axis disposed transverse to this main direction of shock absorption.

8 Claims, 6 Drawing Sheets

SUSPENSION ARRANGEMENT FOR RAIL VEHICLES

BACKGROUND OF THE INVENTION

The present invention relates to a carriage suspension or suspension arrangement for rail vehicles, including at least two annular rubber or elastomeric shock absorbers, each of which is disposed between a mandrel and a bell-shaped element.

Suspension arrangements of the aforementioned general type are known. However, they have the drawback that the elastomeric shock absorbers have a limited spring deflection in the vertical direction, i.e. in the direction of their rolling motion between mandrel and bell-shaped element; in addition, the shock absorbers are very stiff in the direction transverse to this main direction of shock absorption. This is due to the fact that in this direction the material of the elastomeric shock absorbers is primarily subjected to compression. Furthermore, the shock absorption effect in all directions transverse to the main direction of shock absorption is the same.

With this heretofore known type of suspension arrangement, on the one hand the limitation of the spring deflection in the main direction of shock absorption can be a drawback; on the other hand, in particular the insufficient shock absorption effect, which is the same in the longitudinal and transverse directions of the vehicle, is not satisfactory for the operating behavior of the rail vehicle because it is impossible to have an optimum shock absorption and damping, especially of the lateral contact impacts of the wheels against the rails. It is also impossible with the known suspension arrangements to radially adjust the assembly or wheel sets when traveling through curves. Thus, not only the traveling comfort but also the wear characteristics of the heretofore known arrangements are unsatisfactory.

A number of constructions have been proposed in order to avoid the drawbacks of the aforementioned suspension arrangements. With these proposals, annular elastomeric shock absorbers are combined with elastomeric layered springs, steel springs, pneumatic shock absorbers, and linkage or lever arrangements in order to be able to use, as the main shock absorption element, the elastomeric shock absorber with its positive characteristics, and in order to avoid the aforementioned drawbacks with respect to stiffness in a direction transverse to the main direction of shock absorption.

It is an object of the present invention to provide a suspension arrangement having at least two annular elastomeric shock absorbers, with such a suspension, at the least possible expense, having an optimum adjustability of the assembly in the longitudinal and transverse directions of the vehicle, and having a greater spring deflection in the main direction of shock adsorption.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
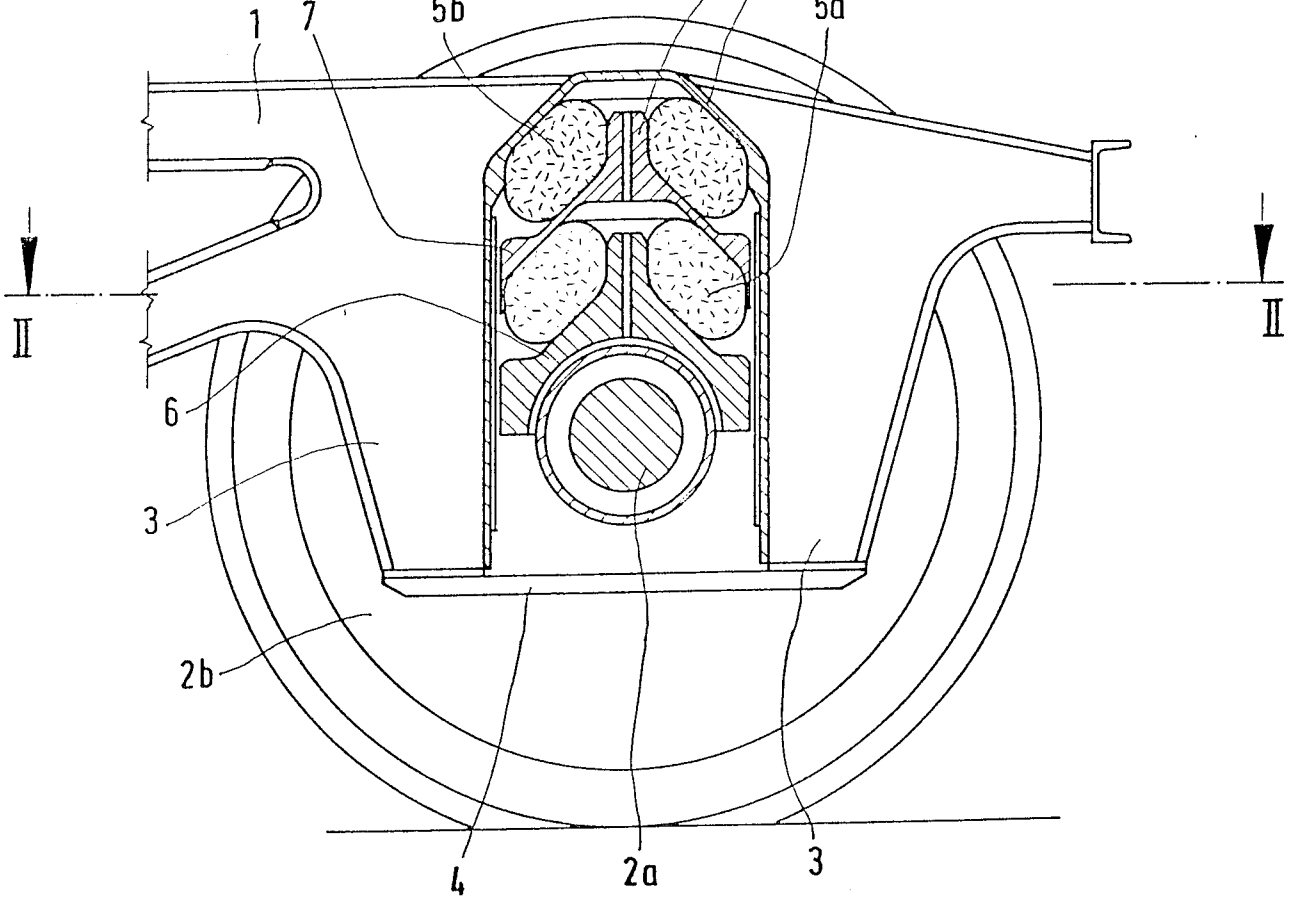
FIG. 1 is a vertical cross-sectional view through a first exemplary embodiment of the suspension arrangement of the present invention.

The suspension arrangement of the present invention comprises at least one pair of superimposed elastomeric shock absorbers, including a first shock absorber disposed between a first mandrel and a first bell-shaped member, and a second shock absorber disposed between a second mandrel and a second bell-shaped member, with the first bell-shaped member and the second mandrel being disposed between the shock absorbers and being interconnected in such a way that they can carry out not only a movement in the main direction of shock absorption, but also a pendulum movement about any axis disposed transverse to the main direction of shock absorption.

With this inventive configuration, there results a sequential or series arrangement of the elastomeric shock absorbers, as a result of which on the one hand their spring deflection is increased in the main direction of shock absorption, and on the other hand there is provided a possibility for affecting the stiffnesses that act transverse to this main direction, this being possible since the interconnected parts, namely the bell-shaped member and mandrel, can be turned about an axis disposed at right angles to the main direction of shock absorption. This turning effects an essentially tangential thrust of the two elastomeric shock absorbers, with this tangential thrust leading to lower or smaller stiffness of the shock absorbers than is possible with compressive stress, so that the inventive shock absorption combination via twisting-rotational distortion thereof is softer in elasticity transverse to the main direction of shock absorption than compressive elasticity thereof during linear movement in main spring direction of shock absorption. Especially via the effective lever arm lengths, the stiffness of the inventive suspension arrangement transverse to the main direction of shock absorption can be adjusted and adapted to the applicable requirements.

In order with the inventive suspension arrangement to be able to provide different stiffnesses in the longitudinal and transverse directions of the vehicle, it is proposed pursuant to a further feature of the invention including at least one of the elastomeric shock absorbers with a shape other than a circular ring shape.

The same result can be achieved if, pursuant to the present invention, at least two elastomeric shock absorber arrangements or pairs that operate parallel to one another are disposed next to one another, with the interconnected bell-shaped member and mandrel of each pair in turn being interconnected by a bar in such a way as to be able to transfer torque.

Pursuant to a further feature of the present invention, the bar can be elastic or can be resiliently connected to at least one of the bell-shaped members such that the more resilient the connection thereof, then the softer is the resiliency or spring arrangement in this direction, i.e. preferably in the longitudinal direction of the vehicle.

A further possibility for adjusting the stiffness of the shock absorption transverse to the main direction of shock absorption is the inventive proposal of limiting the movability of that bell-shaped member that is connected with a mandrel in the plane disposed transverse to the main direction of shock absorption by abutments. The greater the possibility of movement of the bell-shaped member, accordingly then the softer is the spring arrangement or shock absorption orientation in this direction. Thus in this manner also different stiffnesses can be achieved by loading the shock absorber arrangement in a plane disposed transverse to the main direction of shock absorption. In practice, it is generally a matter of the stiffness in the longitudinal and transverse directions of the vehicle.

It is finally proposed pursuant to the present invention that the abutments be resilient. With such resilient abutments, the change of hardness of the shock absorption transverse to the main direction of shock absorption is reduced when an abutment is contacted, so that it is possible to adapt the shock absorption characteristic to the respective needs not only by varying the distances between bell-shaped members and mandrels, but also by varying the resiliency of the abutments. Thus, with the inventive shock absorption arrangement, sufficient possibilities are available for affecting the shock absorption characteristic when the elastomeric shock absorbers are stressed transverse to their main direction of shock absorption.

Further specific features of the present invention will be described in detail subsequently.

DESCRIPTION OF PREFERRED EMBODIMENTS

Referring now to the drawings in detail, all of the embodiments show a portion of a truck or bogie frame 1 which, via respective carriage suspensions, is supported on the ends 2*a* of at least two axles 2. The drawings also show one of the wheels 2*b* of a given axle 2.

Figure 2:
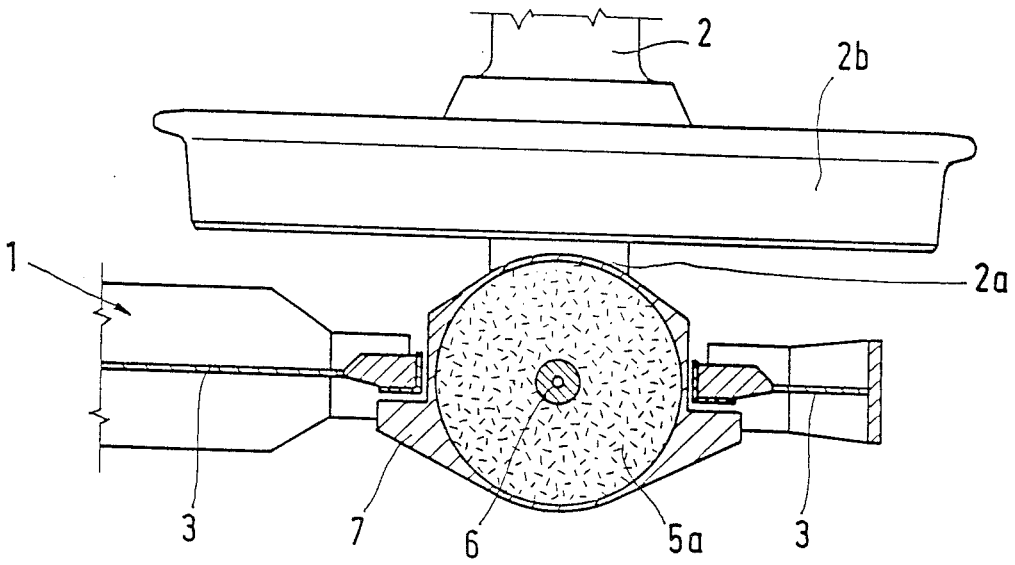
FIG. 2 is a horizontal cross-sectional view through the suspension arrangement of FIG. 1, and is taken along the line II—II thereof.
Figure 3:
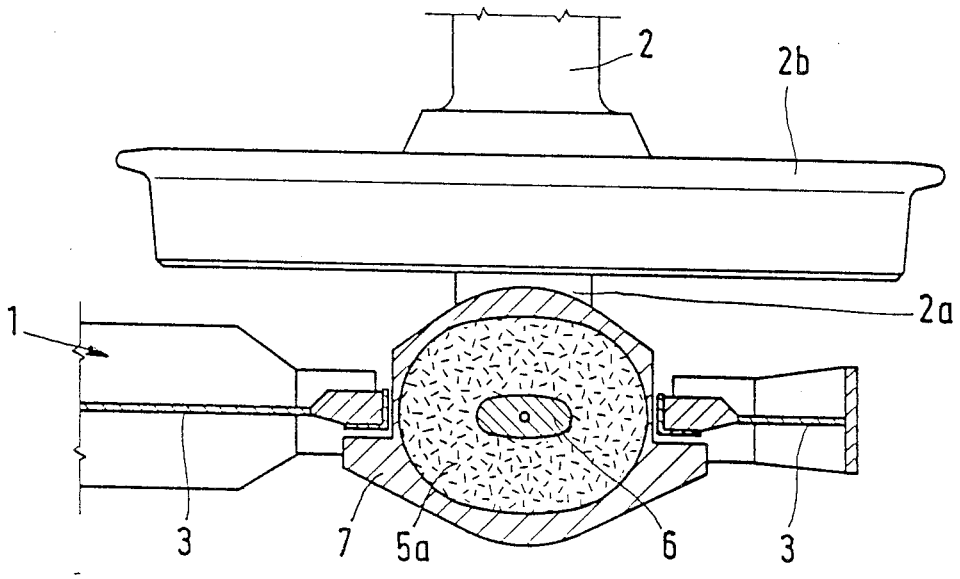
FIG. 3 is a view similar to that of FIG. 2 showing a modified embodiment having an oval elastomeric shock absorber.

In the first embodiment of FIGS. 1 and 2, as well as in the modified embodiment of FIG. 3, the bogie frame 1 is provided with pairs of axle supports 3 that undertake the support function between the bogie frame 1 and the axle 2. To prevent an unintentional lifting of the bogie frame 1 from the axles 2, and to reinforce the bogie frame, the cooperating axle supports 3 are interconnected by an axle support spanner 4.

The suspension arrangement illustrated in FIGS. 1–3 includes two annular rubber or elastomeric shock absorbers or resilient-roll spring means 5*a* and 5*b* that are disposed one above the other. The lower shock absorber 5*a* is disposed on a mandrel 6 which in the illustrated embodiment also serves as an axle bearing housing; this mandrel could, however, also be embodied as an adaptor that is supported on the axle bearing. Disposed on the lower shock absorber 5*a*, as an upper shock absorber housing, is a bell-shaped member 7 that is connected to the mandrel 8 for the upper shock absorber 5*b*. In the embodiment illustrated in FIG. 1, the member 7 and the mandrel 8 are embodied as a single piece. Finally, a bell-shaped top 9 is supported on the upper shock absorber 5*b*; the top 9 is securely mounted to the bogie frame 1.

Due to the above-described arrangement, there results a sequential connection of the elastomeric shock absorbers 5*a* and 5*b*, with each of the latter having an identical configuration and undertaking half of the vertical shock deflection. As a result, the dimensions of each of the elastomeric shock absorbers 5*a* and 5*b*, especially with regard to the height and diameter thereof, are so favorable that the shock absorbers 5*a* and 5*b* can be disposed over the axle bearings. Furthermore, due to this sequential or series arrangement of the two shock absorbers 5*a* and 5*b*, a sufficient shock deflection can be achieved in the vertical direction, i.e. in the main direction of shock absorption.

As a result of the connection of the bell-shaped member 7 for the lower shock absorber 5*a* with the mandrel 8 for the upper shock absorber 5*b*, it is possible for the member 7 and the mandrel 8 to move in the manner of a fixed pendulum about an axis disposed at right angles to the main direction of shock absorption. This movement effects an essentially tangential thrust on the two elastomeric shock absorbers 5*a* and 5*b*, and also effects a resiliency of the suspension arrangement transverse to the main direction of shock absorption. Return or elastic forces result due to the tangential thrust of the shock absorbers 5*a* and 5*b*. Thus, the suspension arrangement can absorb relative movements between the bogie frame 1 and the axle 2 that occur in the longitudinal direction of the vehicle. These relative movements are necessary, especially for optimum shock absorption and damping, especially of the lateral contact impacts of the wheels 2*b* against the rails, and for radial adjustment of the wheel sets when traveling through curves.

To provide different stiffnesses of the suspension arrangement in the longitudinal direction of the vehicle and the transverse direction of the vehicle, the elastomeric shock absorbers 5*a* and 5*b* can have a shape other than a circular ring shape. For example, whereas the shock absorbers 5*a* and 5*b* of the first embodiment of FIGS. 1 and 2 have the shape of a circular ring, the modification illustrated in FIG. 3 shows an oval embodiment for the shock absorbers 5*a* and 5*b*, and hence also for the mandrels 6 and 8 and the bell-shaped member 7 and top 9. Since the longer axis of the oval shape is disposed in the longitudinal direction of the vehicle, a greater rigidity results in this direction than in the transverse direction of the vehicle.

Figure 4:
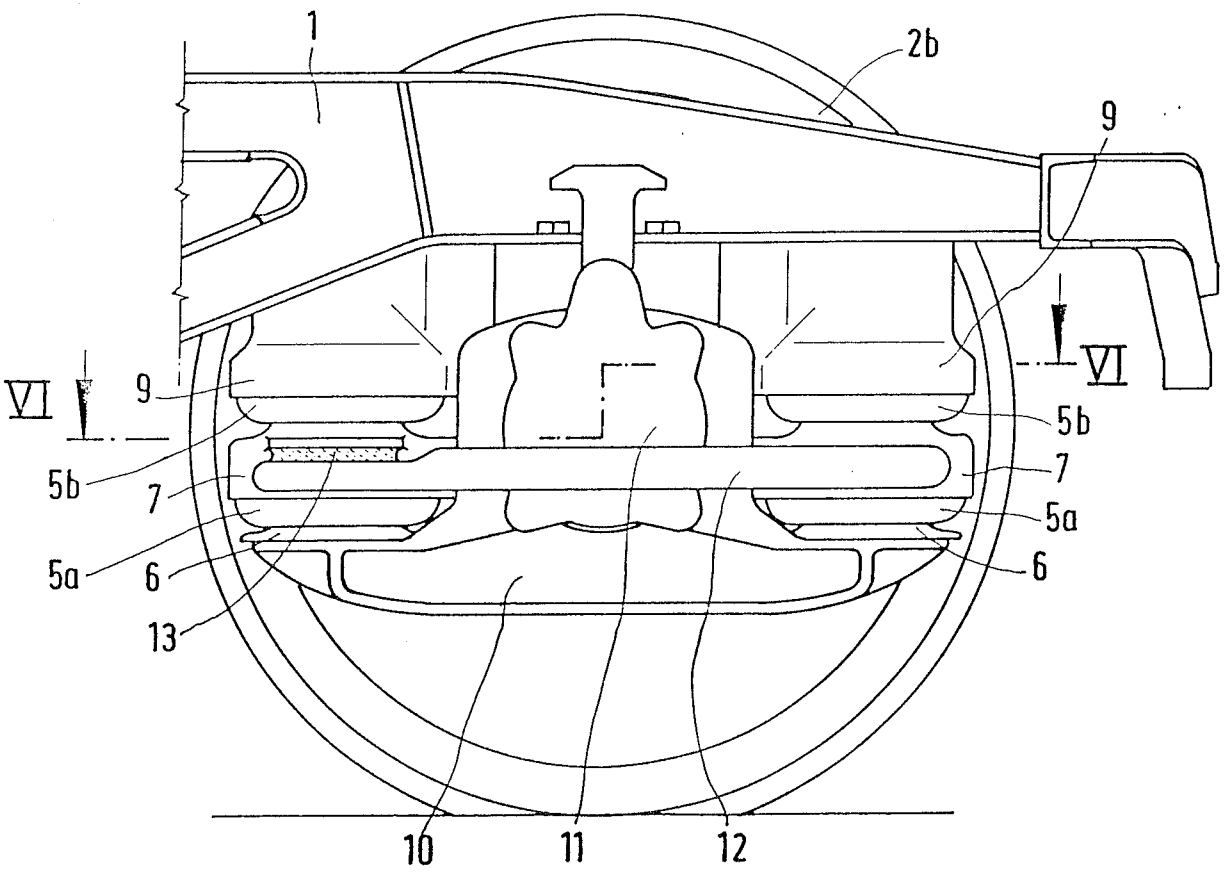
FIG. 4 is a side view of a further exemplary embodiment showing two elastomeric shock absorber arrangements that are disposed next to one another and operate parallel to one another.
Figure 5:
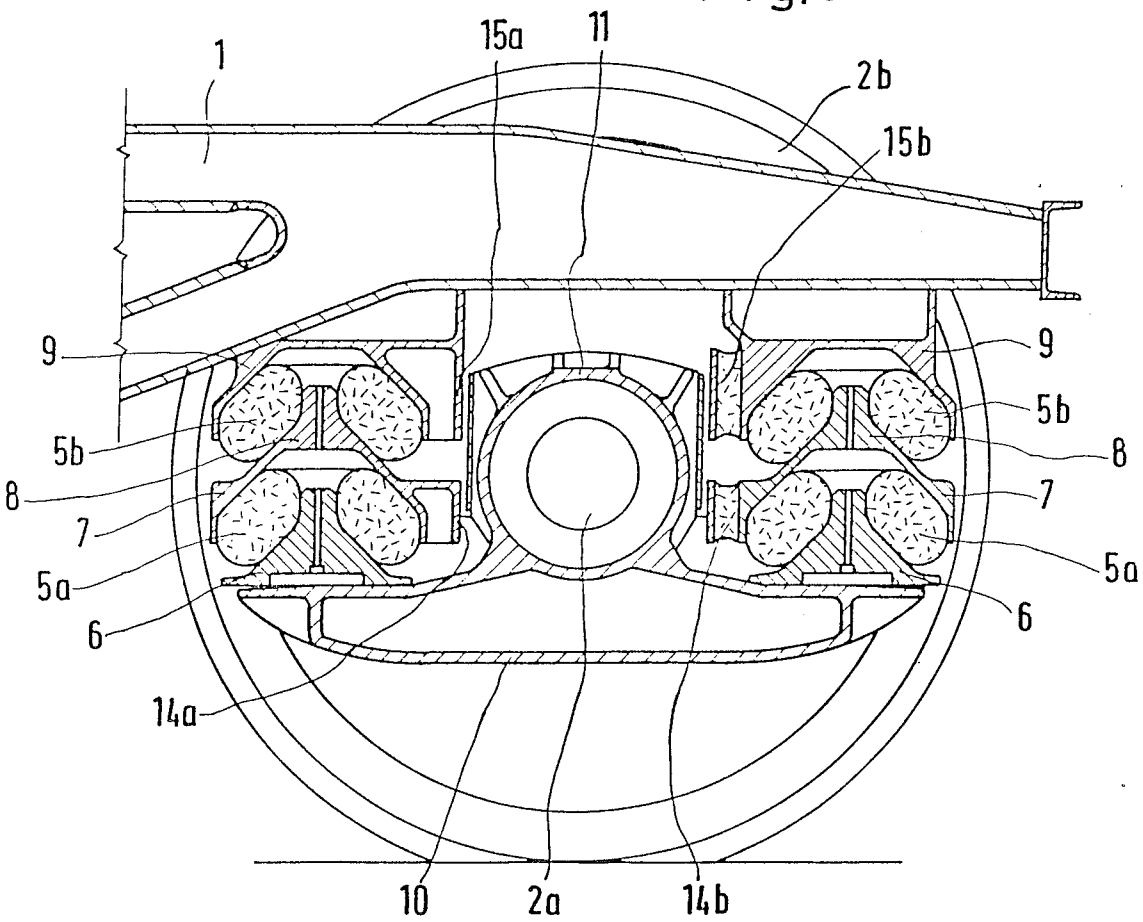
FIG. 5 is a vertical cross-sectional view through the suspension arrangement of FIG. 4.
Figure 6:
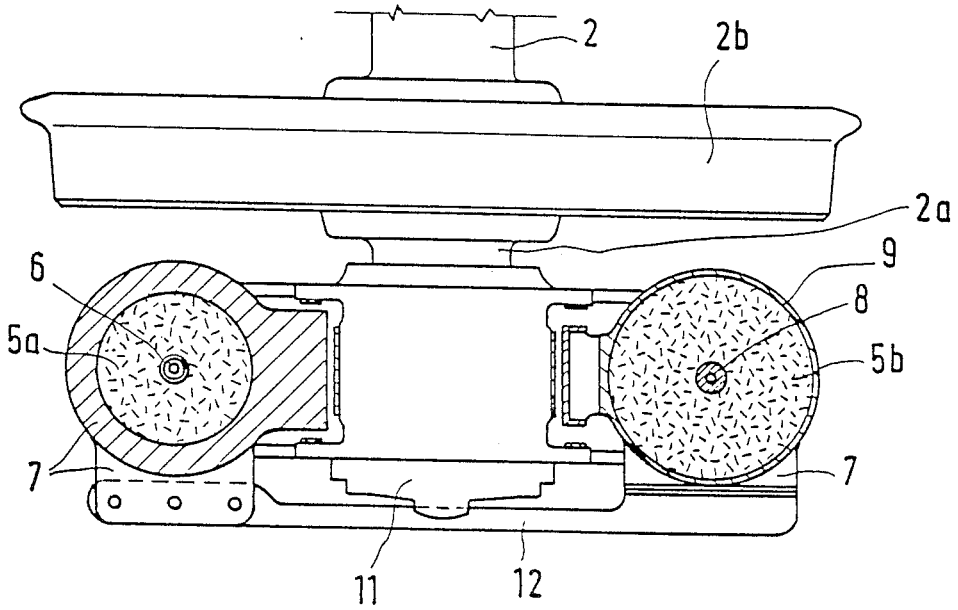
FIG. 6 is a horizontal cross-sectional view through the suspension arrangement of FIGS. 4 and 5 and is taken along the line VI—VI in FIG. 4.

In the third embodiment illustrated in FIGS. 4–6, two arrangements of annular rubber or elastomeric shock absorbers that operate parallel to one another are disposed next to one another. In this embodiment, the mandrel 6 of the lower shock absorbers 5*a* is disposed on a support element 10 that extends in the longitudinal direction of the vehicle and is part of the axle bearing housing 11. The bell-shaped tops 9 of the upper shock absorbers 5*b* are secured to the bogie frame 1. As can be seen from FIGS. 4 and 6, the two sets of interconnected bell-shaped members 7 and mandrels 8 can in turn be connected to one another by a bar 12 in such a way as to be able to transfer torque. As a result, there is again achieved a different rigidity in the longitudinal and transverse directions of the vehicle. In order to affect the rigidities, the bar 12 can be elastic or can be resiliently connected to at least one of the bell-shaped members 7. In FIG. 4, a resilient intermediate element 13 is disposed between the left end of the bar 12 and the associated bell-shaped member 7.

Finally, in the embodiment illustrated in FIGS. 4–6, the ability of a given bell-shaped member 7 that is connected to the mandrel 8 and is associated with one of the two elastomeric shock absorber arrangements of a given axis 2 to move is limited by an abutment 14*a*, which could also be embodied as a resilient abutment 14*b*. Thus, in this way also different rigidities can be achieved in the longitudinal and transverse directions of the vehicle. The greater the possibility for the bell-shaped member 7 to move, the softer is the shock absorption arrangement. To assure the guidance necessary for the axle bearing housing 11, in the embodiment of FIG. 5, the upper bell-shaped top 9 is also provided with an abutment 15*a* or 15*b*.

In all of the embodiments, the superimposed elastomeric shock absorbers 5*a* and 5*b* transmit the vertical shock absorption, as well as all transverse and longitudinal forces, from the wheel set to the bogie frame 1. Furthermore, the shock absorbers 5*a* and 5*b* permit the necessary longitudinal and transverse paths to enable axle adjustments when traveling through curves, and to enable the damping of contact impacts. At the same time, the elastomeric shock absorbers 5*a* and 5*b* produce the necessary return forces in order to always return the wheel set to its mid-position.

Since as the load of the previously described suspension arrangement increases, the length of the fixed or upright pendulum becomes smaller due to increasing inward deflection, i.e. a shortening of the pendulum results as the load increases, the return force component of this load becomes greater, so that despite the straightforward and compact construction not only of the suspension arrangement, but also of the points of suspension on the bogie frame, optimum functioning results.

The previously described suspension arrangement can be utilized not only for the bogies illustrated in the embodiments, but also for rail vehicles having dual axles. Furthermore, the inventive suspension arrangement can be used not only as the primary shock absorption mechanism, but also as the secondary shock absorption for bogies of passenger railway cars. Moreover, the suspension arrangement can be used for shock absorption for locomotive bodies with regard to drive bogies or independent axles.

The present invention is, of course, in no way restricted to the specific disclosure of the specification and drawings, but also encompasses any modifications within the scope of the appended claims.

What we claim is:

1. A multi-stage spring suspension arrangement for rail vehicles having at least two resilient-roll spring means arranged superimposed and having a main spring direction of shock absorption along which a spring deflection exists although permitting an adjustability of the arrangement for shock absorption movement in longitudinal and transverse directions of a vehicle, the improvement in combination therewith comprising:

at least one pair of superimposed elastomeric shock absorbers, having bell-shaped and mandrel parts spaced relative to each other as well as spaced relative to said resilient-roll spring means located in axial relationship with conical surfaces of said bell shaped and mandrel parts being parallel and having a first elastomeric shock absorber disposed between a first mandrel and a first bell-shaped member, and a second elastomeric shock absorber disposed between a second mandrel and a second bell-shaped member, with said first bell-shaped member and said second mandrel being disposed between said first and second shock absorbers having an added series arrangement of elasticity via twisting-rotational distortion in said elastomeric shock absorbers via said mandrels collectively having much softer elasticity in the transverse direction than compressive elasticity thereof during linear movement in said main spring direction of shock absorption and being interconnected to carry out not only a movement in the main spring direction of shock absorption, but also additionally to carry out a pendulum movement about any axis disposed transverse to said main spring direction of shock absorption, said first mandrel being embodied independently of said second mandrel to carry out a translatory movement and also a rotational movement since said mandrels are arranged independently of each other to permit shifting displacement thereof as is true also for said first and second bell-shaped members relative to each other although being coupled to permit linear movement in said main spring direction of shock absorption as well as to permit said bell-shaped and mandrel parts being arranged to carry out said pendulum movement around an axis located transverse to the main direction of shock absorption while said first bell-shaped member and said second bell-shaped member are subjected to a parallel shifting displacement upon encountering horizontal forces as well as longitudinal forces during the twisting-rotational distortion permitted by the arrangement via the elastomeric shock absorbers during the shock absorption movement of the vehicle in the longitudinal and transverse directions of the vehicle.

2. A suspension arrangement in combination according to claim 1, in which each of said shock absorbers has a circular, ring-shaped transverse cross-sectional shape.

3. A suspension arrangement in combination according to claim 1, in which at least one of said shock absorbers of a given pair of shock absorbers has a transverse cross-sectional shape that is other than circular.

4. A suspension arrangement in combination according to claim 1, which includes at least two pairs of shock absorbers that operate parallel to one another and are disposed next to one another, with said interconnected second mandrel and first bell-shaped member of a given pair in turn being connected to said interconnected second mandrel and first bell-shaped member of another pair, via a bar, in such a way as to be able to transfer torque.

5. A suspension arrangement in combination according to claim 4, in which said bar is elastic.

6. A suspension arrangement in combination according to claim 4, in which said bar is resiliently connected to at least one of said first bell-shaped members.

7. A suspension arrangement in combination according to claim 1, which includes abutment means to limit the mobility of said interconnected first bell-shaped member in a plane disposed transverse to the main direction of shock absorption.

8. A suspension arrangement in combination according to claim 7, in which said abutment means are resilient.

* * * * *